US009053683B1

(12) United States Patent
Head

(10) Patent No.: US 9,053,683 B1
(45) Date of Patent: Jun. 9, 2015

(54) STRING INSTRUMENT'S EXTENSION FOR ACTIVATING KEYBOARD'S KEYS

(71) Applicant: Jerry Head, Miramar, FL (US)

(72) Inventor: Jerry Head, Miramar, FL (US)

( * ) Notice: Subject to any disclaimer, the term of this patent is extended or adjusted under 35 U.S.C. 154(b) by 0 days.

(21) Appl. No.: 14/300,785

(22) Filed: Jun. 10, 2014

(51) Int. Cl.
*G10D 3/00* (2006.01)

(52) U.S. Cl.
CPC ..... *G10D 3/00* (2013.01)

(58) Field of Classification Search
CPC ..... G10D 1/08; G10D 17/00; G10D 3/00; G10D 3/10; G10C 3/12; G10C 3/00; G10C 5/00; G10G 5/00
USPC ..... 84/236, 267, 423 R, 421
See application file for complete search history.

(56) References Cited

U.S. PATENT DOCUMENTS 7,825,311 B1 * 11/2010 Williams ..... 84/236

* cited by examiner

*Primary Examiner* — Kimberly Lockett
(74) *Attorney, Agent, or Firm* — Jesus Sanchelima; Christian Sanchelima

(57) ABSTRACT

An accessory device removably mounted to the headstock of a string instrument including an arm assembly for, actuating the keys of a keyboard instrument. The distal end of the arm assembly includes at least one tip cooperatively shaped to actuate the keys of a keyboard instrument. The arm assembly having an elongated arm member that is slidably and lockingly mounted to a clamp assembly that is removably mounted to the stock.

5 Claims, 2 Drawing Sheets

STRING INSTRUMENT'S EXTENSION FOR ACTIVATING KEYBOARD'S KEYS

BACKGROUND OF THE INVENTION

1. Field of the Invention

The present invention relates to an accessory for musical string instruments and, more particularly, to such an accessory that permits a user playing a string instrument to actuate, simultaneously, a keyboard musical instrument.

2. Description of the Related Art

Several designs for musical accessories that permit a user to play two instruments simultaneously have been designed in the past. None of them, however, include a simple extension for string instruments with head stocks that allows a user to simultaneously actuate keys of an electric music keyboard.

Applicant believes that one of the related references corresponds to U.S. Pat. No. 7,825,311 issued to Williams in 2010 for a Keyboard Guitar Musical Instrument Apparatus. However, it differs from the present invention because the keyboard needs to be in close proximity to the user to be directly actuated. This requires a special apparatus for each keyboard instrument to be played. The present invention allows a user to remotely actuate the keys and can be readily adjusted for the characteristics of different instruments.

Other documents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide an extension accessory for string instruments that permit a user to simultaneously operate the keys of another musical instrument.

It is another object of this invention to provide such an accessory that can be readily mounted to string instruments having different head stock configurations.

It is still another object of the present invention to provide an accessory for musical instruments that can be readily adjusted to actuate keyboard musical instruments with different key dimensions and spacing.

It is yet another object of this invention to provide such accessory that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figures 1, 1A:
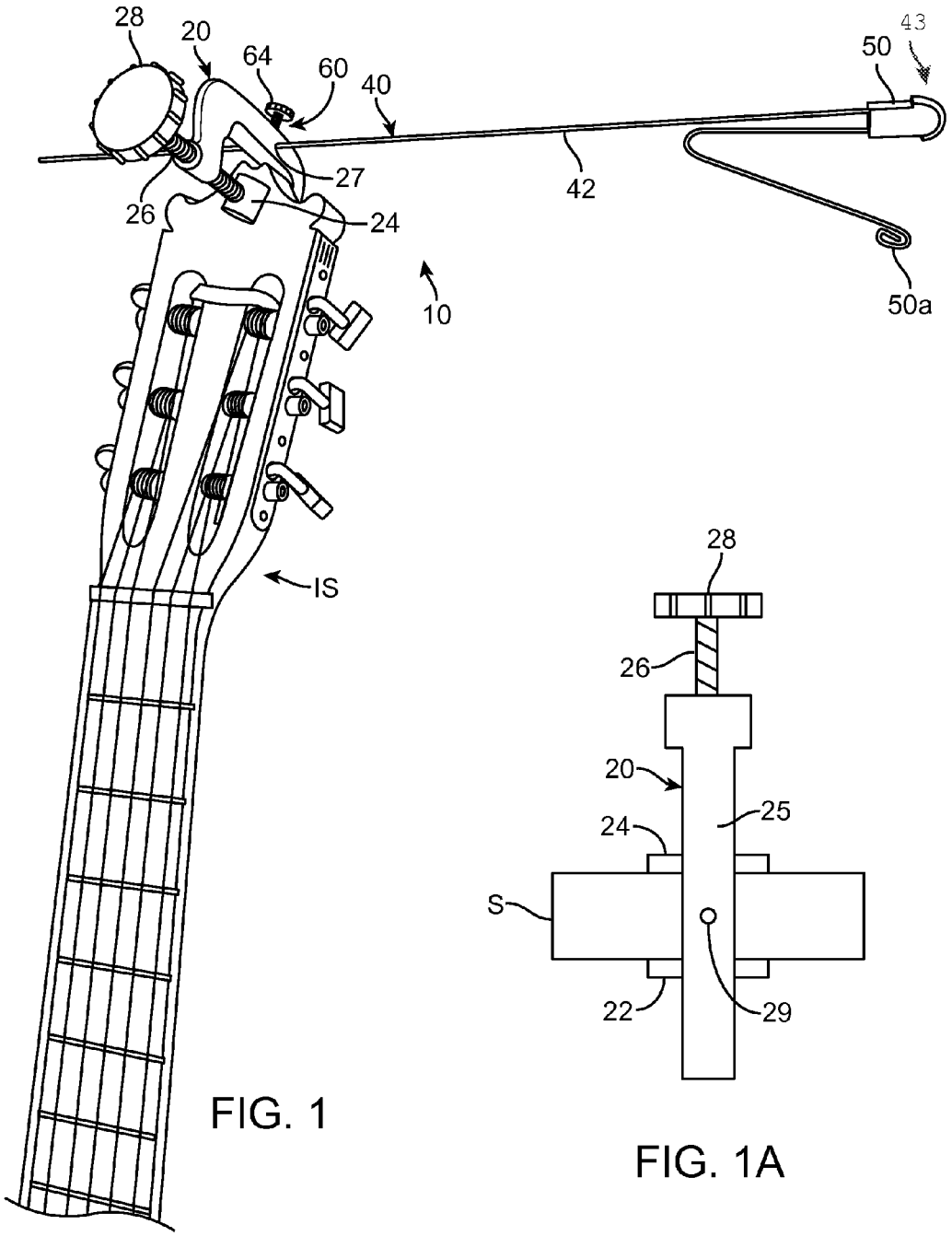
FIG. 1 represents an isometric view of the extension accessory for string instruments with a user simultaneously actuating the keys of a musical keyboard.
FIG. 1A is an end view representation of the instrument stock with one of the preferred embodiments of the present invention mounted thereon.
Figure 2:
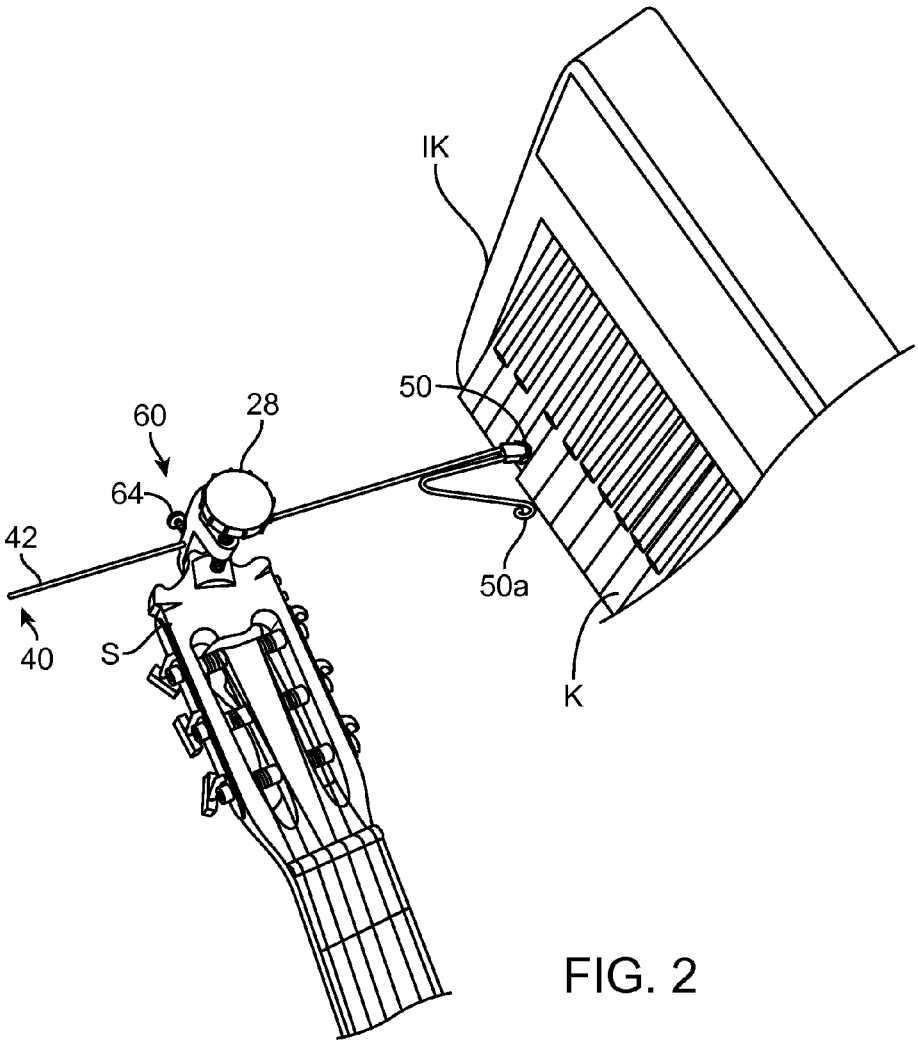
FIG. 2 shows an isometric view of the accessory actuating a musical keyboard instrument.
Figure 2A:
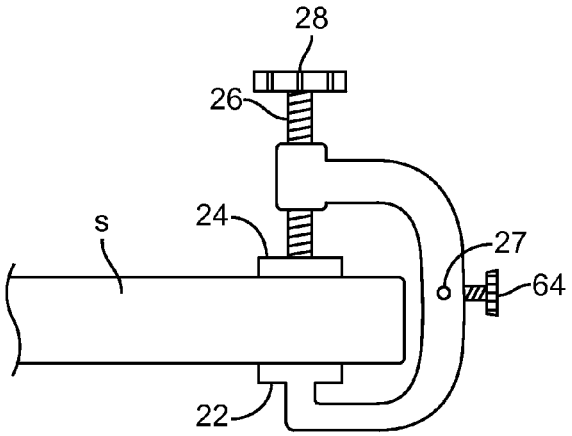
FIG. 2A is a partial elevational view of a head stock with the accessory mounted thereon.

Referring now to the drawings, where the present invention is generally referred to with numeral 10, it can be observed that it basically includes main clamp assembly 20, elongated arm assembly 40, and length adjustment set screw or clamp assembly 60, as seen in FIG. 1. Arm assembly 40 includes one or two tip members 50; 50*a* mounted at the distal end of arm member 42 of assembly 40. Tip members 50 and/or 50*a* are selectively brought in contact with keys K of a musical keyboard instrument IK, as best seen in FIG. 2.

Clamp assembly 20 is implemented, in one of the embodiments, with a C-clamp (also known as a G-clamp). See https://en.wikipedia.org/wiki/C-clamp, last visited Apr. 14, 2014. Flat edge 22 at one end of C-shape body 25 is brought against the outer surface of stock S of string instrument IS, as shown in FIG. 1. Flat edge 24 at the end of screw 26 is brought in contact with stock S at its opposite side. Screw 26 is turned until clamp assembly 20 is firmly attached to head stock S. Knob 28 is turned to impart the necessary rotation to screw 26. Equivalent variations of clamp assembly 20 can be used provided that the equivalent mechanisms function to firmly secure assembly 20 to head stock S of string instrument IS.

C-shaped clamp body 25 includes through opening 27 for allowing arm member 42 of elongated arm assembly 40 to slidably pass through.

C-shaped clamp body 25 of clamp assembly 20 also includes a set screw or second clamp referred to as arm adjustment clamp assembly 60 for locking arm member 42 at a predetermined position with respect to body 25, as seen in FIG. 1. Threaded opening 29 in clamp body 25 is perpendicular through opening 27, as seen in FIG. 1A. Set screw member 64 mates with threaded opening 29 with its tip advancing until it comes in contact with arm member 42. Further advancing screw member 64 locks arm member 42 in place.

Arm assembly 40 includes tip 50 and optional tip 50*a* at the distal end of arm member 42. Tips 50; 50*a*, in one of the embodiments, are defined by bending arm member 42 twice so that the first bend is for 360 degrees and returns a predetermined distance where the second bend is formed. Depending on how far back the predetermined distance is, an angle is selected to cause tip 50*a* to be substantially co-extensive with tip 50. As seen in the figures, tips 50 and 50*a* are positioned at substantially the same distance from body 25. Tips 50; 50*a* have cooperative rounded shapes for actuating the keys of a key instrument IK. Tip 50 is implemented with a pressure fitted cap whereas tip 50*a* is merely a coiled end. The material selected for arm member 42 is rigid and malleable so that the relative positions of tips 50 and 50*a* with respect to each other can be adjusted. A user can adjust the separation of tips 50; 50*a* depending on the characteristics of the key instrument IK and his/her preferences.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An extension accessory for string instruments having a head stock comprising:

A) an elongated arm member 42 having first end and second end for remotely actuating at least one key of a key instrument;

B) mounting assembly 40 removably mounted to the head stock of a string instrument and slidably receiving said elongated member 20; and C) a clamp assembly 60 for securing said elongated arm member 42 in place.

2. The accessory set forth in claim 1 wherein said first end includes first and second actuating tips cooperatively shaped to selectively actuate said at least one key.

3. The accessory set forth in claim 2 wherein said first and second tips are substantially coextensive and their separation adjustable with respect to each other.

4. An extension accessory device for string instruments having a head stock comprising:

A) a clamp assembly removably mounted to the head stock of a string instrument; and B) an elongated arm assembly mounted to said clamp assembly and further including a distal end for cooperatively actuating at least one key of a musical keyboard instrument.

5. The accessory device set forth in claim 4 further including:

C) a second clamp assembly removably mounted to said first clamp assembly, said second clamp assembly coacting with said arm assembly to vary the effective distance of said distal end with respect to said head stock.

* * * * *